US005220746A

United States Patent [19]

Yeager

[11] Patent Number: 5,220,746

[45] Date of Patent: Jun. 22, 1993

[54] SLIDE GATE BRAKE MEMBER

[75] Inventor: Gerald E. Yeager, Sterling Heights, Mich.

[73] Assignee: Stanley Home Automation, Novi, Mich.

[21] Appl. No.: 783,389

[22] Filed: Oct. 28, 1991

[51] Int. Cl.[5] ..... E05F 15/14

[52] U.S. Cl. ..... 49/360; 49/506

[58] Field of Search ..... 49/360, 324, 137, 357, 49/358, 506

[56] References Cited

U.S. PATENT DOCUMENTS

| | | | |
|---|---|---|---|
| 3,043,584 | 7/1962 | Kielhorn | 49/360 X |
| 4,065,878 | 1/1978 | Tsugane | 49/360 |
| 4,296,570 | 10/1981 | Balbach et al. | 49/360 |
| 4,941,320 | 7/1990 | Kersten et al. | 49/360 X |

*Primary Examiner*—Philip C. Kannan

*Attorney, Agent, or Firm*—Krass & Young

[57] ABSTRACT

A brake member for a slide gate mechanism which includes a slanted drive mechanism engaging face adapted to engage at least one drive wheel of the drive mechanism for the slide gate so as to gradually brake the gate.

The preferably a pair of opposed drive wheels are adapted to frictionally engage a drive rail on a gate so as to provide a slide gate mechanism. The pair of opposed wheels are spring biased toward the railing to ensure adequate frictional engagement with the rail. Limit switches are disposed to deactivate operation of the drive mechanism and a pair of brake members are disposed so as to positive a slanted drive mechanism engaging face toward the drive wheels of the drive mechanism such that when utilized the brake member operates to gradually brake the gate as the slanted drive mechanism engaging face engages at least one of the drive wheels. Further, the present invention includes a method for controlling the movement of the gate member by providing a switch engaging member on the gate which is adapted to deactivate the operation of the drive mechanism for the gate and further positioning the brake member at a point on the gate after the point at which the gate will normally stop movement. In this manner the brake member operates in emergency situations where the gate does not stop prior to the brake member.

10 Claims, 3 Drawing Sheets

SLIDE GATE BRAKE MEMBER

FIELD OF THE INVENTION

The present invention relates to automated gate mechanisms and more particularly to mechanisms for controlling the movement of a slide gate.

BACKGROUND OF THE INVENTION

Automated gate mechanisms are popular means for securing access to various locations, such as outdoor areas, buildings, or rooms. In the typical embodiment, a gate is pivoted, slid, or otherwise translated across a pathway and access to the area, building, or room beyond the gate is controlled by the position of the gate relative the pathway. In an automated environment, such equipment can provide the necessary security to the given area while minimizing the need for participation by security personnel.

In commercial and industrial settings, it is common to utilize large, fixed-area, slide gates to block roadways, walkways, sidewalks, and other pathways. These slide gates may include chainlink fencing, parallel bars, or other barriers to provide a gate structure sufficient to preclude unwanted passage of individuals beyond the gate when closed. Such gates are typically controlled by a drive mechanism adapted to slide the gate transversely across the pathway from an open to a closed position and vice versa. The drive mechanism typically includes a motorized drive wheel adapted to frictionally engage a portion of the gate itself. By rotating the drive wheel in one direction, the gate is translated across the path and by rotating the drive wheel in the opposite direction the gate is removed from the path.

Slide gates have an inherent problem in precisely stopping the movement of the gate. Industrial size gates are typically quite large and heavy and produce a sizable amount of momentum during movement. Because of this momentum, slide gates typically coast (i.e., continue to slide) a short distance after the drive mechanism has been deactivated. This coasting generally occurs in relatively consistent amounts; however, coasting distances may be affected by foreign objects disposed on the gate, such as ice formations, which increase the weight and thus the momentum of the gate during movement.

It is has been known in the industry to position a fixed rigid post in the path of the gate member. This post is designed to limit movement of the gate by blocking the path of travel of the gate at a given point and thereby defining the maximum amount of travel in that direction. Such rigid posts effectively prevent excess coasting of the gate; however, they have several disadvantages. Fixed rigid posts abruptly limit the movement of the gate. Upon impact with the post, vibrations are transmitted to the various components of the gate mechanism, such as the drive and support systems. These vibrations may directly damage these components when a single impact of sufficient degree is encountered. Additionally, repetitive impacts of a lesser degree eventually begin to weaken or otherwise adversely effect the components.

There is thus a need in the industry to provide a means for braking a slide gate in a controlled manner which does not cause an abrupt cessation of gate movement and its accompanying vibration.

SUMMARY OF THE INVENTION

The present invention relates to an improved braking system for a slide gate mechanism wherein a gate is controllably moved transversely across a pathway by a drive mechanism utilizing at least one drive wheel adapted to frictionally engage a portion of the gate. The invention comprises at least one brake member which includes a slanted drive mechanism engaging face mounted on the portion of the gate which the drive mechanism is adapted to engage. This brake member is adapted to engage the drive wheel of the drive mechanism so as to gradually brake the gate as the slanted drive mechanism engaging face engages the drive wheel. The gradual braking occurs as the slanted face of the brake member becomes wedged between the drive wheel and the gate. Initial contact with the brake member does not cause an abrupt cessation of movement as only the tip of the brake member contacts the drive wheel. As contact with the brake member gradually increases, braking effect correspondingly increases so as to stop the gate without an abrupt cessation of movement.

In the preferred embodiment, the slanted face of the brake member forms an angle of between 30°–45° with the base of the brake member and correspondingly with the planar surface of the drive rail. It has been found that an angle substantially greater than 45° operates more akin to a fixed post of the prior art so as to abruptly stop the gate movement. Thus, a shallower angle is necessary to effect the gradual stopping of the gate. A very shallow angle could be utilized with large brake members; however, it has been found that angled faces of 30°–45° produce sufficient braking without requiring such lengthy brake members.

In the preferred embodiment, a drive rail is secured along the gate and the drive mechanism includes a pair of drive wheels which are spring biased toward each other and are adapted to frictionally engage the drive rail therebetween. The spring biased nature of the drive wheels ensures adequate frictional engagement with the drive rail. Additionally, this spring biased feature of the drive wheels allows the wheel to give slightly upon contact with the brake member so that the brake member can more gradually wedge between the drive rail and a wheel.

Further in the preferred embodiment, at least one limit switch is disposed on the drive mechanism which is operated to deactivate the drive mechanism when tripped. Corresponding, at least one switch engaging member is disposed on the gate to trip the limit switch after the gate has moved beyond a predefined distance. Further in the preferred embodiment, it is preferable to have the switch engaging member disposed on the portion of the gate which holds the brake member so as to conveniently control the relative positions thereof.

In the preferred embodiment, a pair of brake members are disposed on opposite ends of the drive rail secured to the gate and each operating respectively to brake the gate as it is moved in either direction. More preferably, a limit switch and switch engaging member are disposed proximate opposite ends of the gate for use as the gate moves in either direction.

In the most preferred embodiment, the brake member is positioned on the gate beyond the point where the gate will typically stop coasting after being deactivated by the limit switch. In this manner, the brake member acts only in emergency situations where the gate coasts more than a normal amount. By positioning the brake member beyond the point where the gate would typically stop, the brake member only impacts the wheels in such emergency situations and accordingly minimizes impact vibrations resultant from contact with the brake member.

The present invention thus encompasses a preferred method of controlling the movement of a gate member wherein a movable gate and associated drive mechanism is provided and a switch engaging member is provided on the gate which is adapted to deactivate the operation of the drive mechanism by tripping a limit switch thereon. Further, the method includes the step of positioning a brake member on the gate at a point beyond the point where the gate will stop after the switch engaging member deactivates the drive mechanism. This brake member includes a slanted drive mechanism engaging face such that in situations where the gate does not stop prior to the brake member, the brake member gradually brakes the gate.

BRIEF DESCRIPTION OF THE DRAWINGS

These and other objects and aspects of the invention will become apparent in the detailed description of the invention hereinafter with respect to the drawings in which.

DETAILED DESCRIPTION OF THE PREFERRED EMBODIMENT

Figure 1:
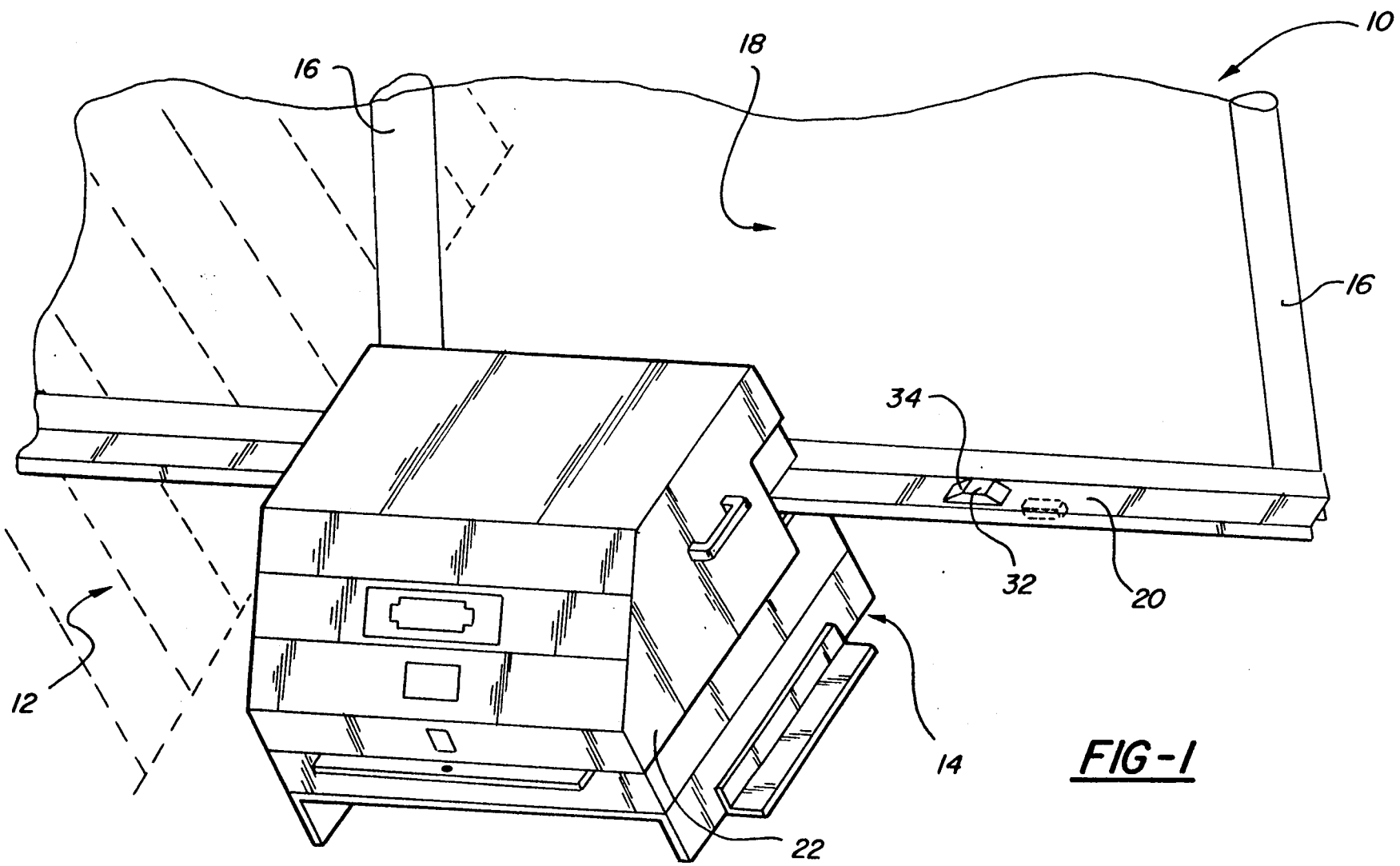
FIG. 1, is a perspective view of the drive mechanism in a section of the gate utilizing the present invention.
Figure 3:
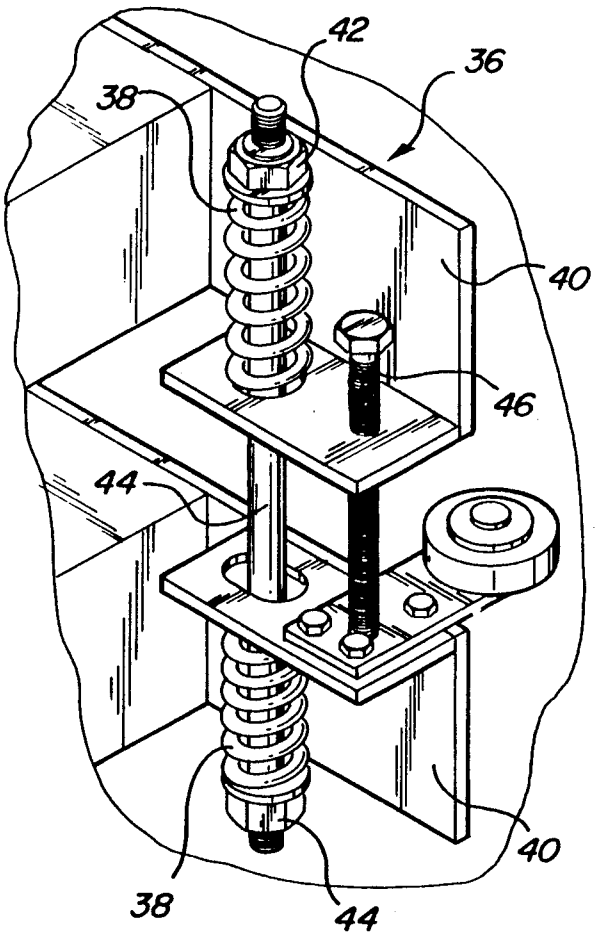
FIG. 3 is a detailed perspective view of the mounting and spring biasing arrangement for the drive wheels associated with the drive mechanism.
Figure 2:
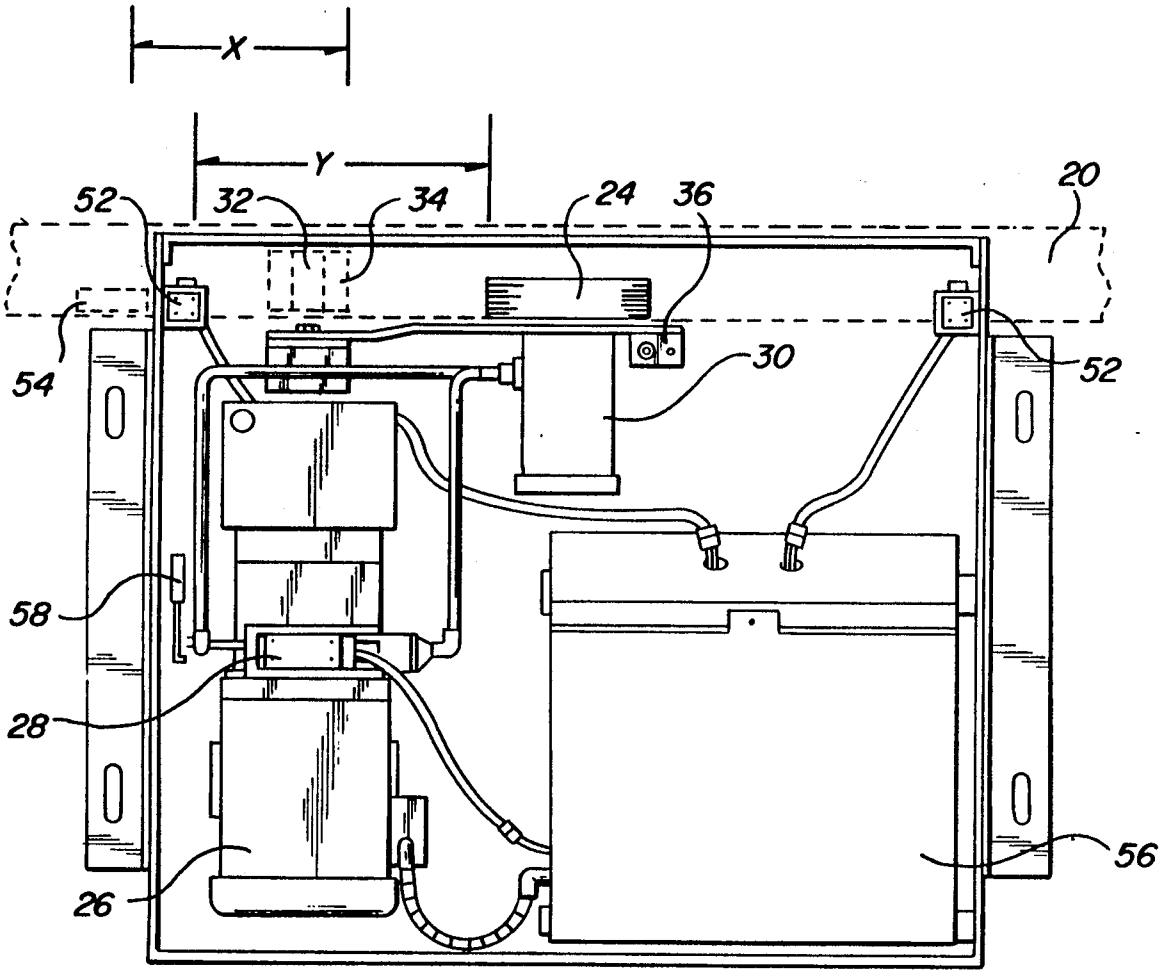
FIG. 2 is a cutaway overhead view of the drive mechanism.
Figure 5:
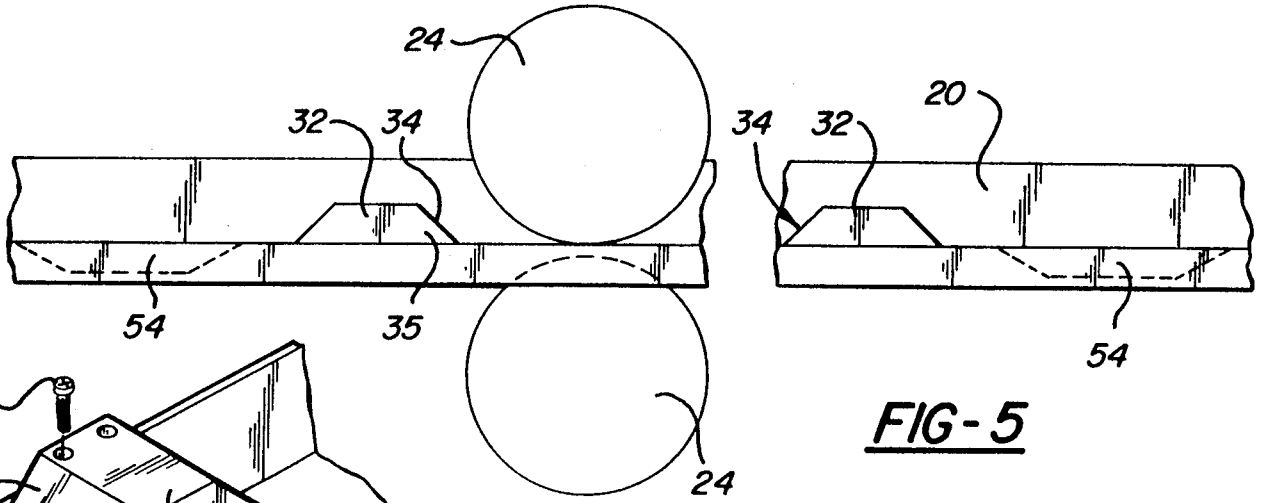
FIG. 5 is a side view of the drive rail showing the relationship between the drive wheels and the brake members.
Figure 7:
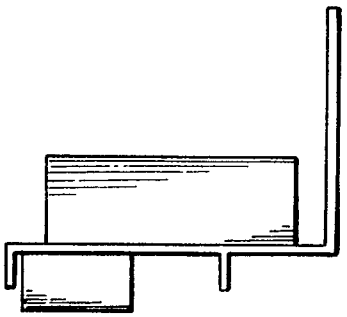
FIG. 7 is an end view of a section of the drive rail.
Figure 6:
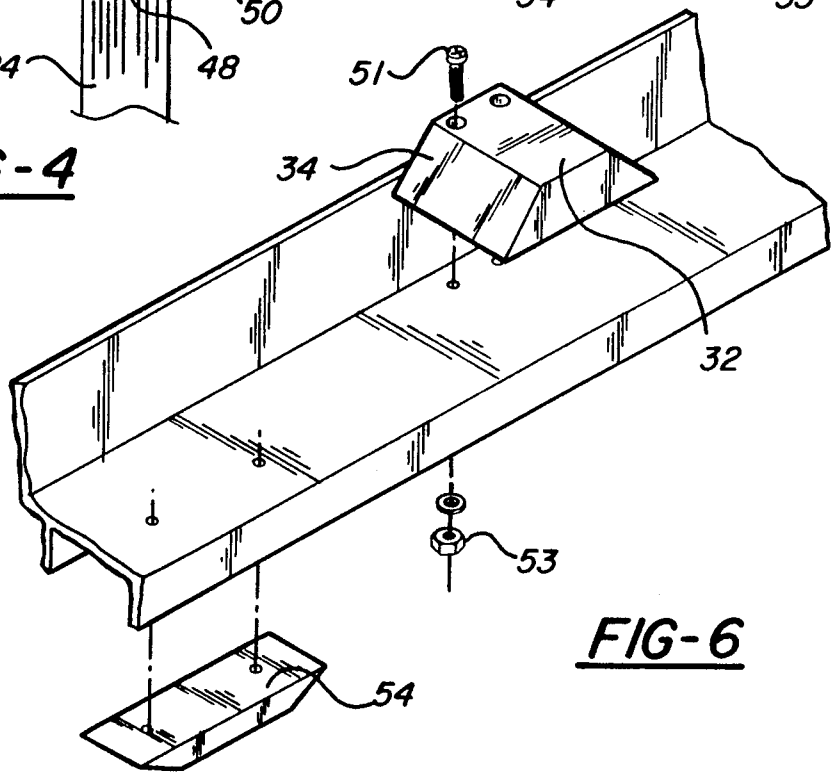
FIG. 6 is, a exploded perspective view of a section of the drive rail.
Figure 4:
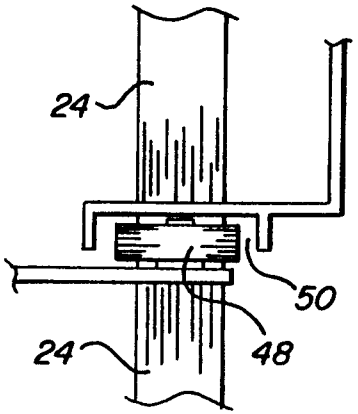
FIG. 4 is a detailed end view showing the relation of the drive wheels to the drive rail.

With reference to FIG. 1, the present invention provides an improved braking system for a gate mechanism wherein a slide gate 10 is controllably moved transversely across a pathway 12 (represented by dashed line shading) by a drive mechanism 14. The gate 10 is composed of spaced apart support beams 16 and a body 18 of wallforming material 18, such as chainlink fencing, bars, or other structures (not individually shown), to provide a sturdy, fixed-area gate 10. Additionally, a drive rail 20 extends along the bottom portion of the gate 10 and is adapted to be engaged by the drive mechanism 14 for movement of the gate.

With reference also to FIGS. 2 to 7, the drive mechanism 14 is adapted to receive a relatively planar portion of the drive rail 20 inside the housing 22 of the drive mechanism. The drive mechanism 14 comprises an AC motor and pump combination 26 linked via a directional valve 28 to a hydraulic motor 30 adapted to drive the pair of drive wheels 24 in opposed rotation. The pair of drive wheels 24 have an outer elastomeric surface adapted to frictionally engage opposed surfaces of the drive rail 20 of the gate 10 so as to move the gate 10 upon activation of the drive mechanism 14. Means for activating the drive mechanism 14 are well known in the industry and are not specifically shown.

The pair of drive wheels 24 are spring biased toward each other so as to give slightly upon impact with the brake member 32 and to frictionally engage the drive rail 20 therebetween with adequate frictional engagement to control the movement of the gate 10. The suspension system 36 for the drive wheels 24 includes a pair of springs 38 adapted to bias the wheel supports 40 together. By tightening the nuts 42 on threaded bar 44 running internally of the springs 38, additional pressure may be placed on the drive wheels 24 biasing them toward the drive rail 20. Separator bolt 46 is useful in fixing the wheels apart for service and is normally removed or otherwise held inoperative during use to allow free movement of the wheels in engaging the drive rail 20.

A brake member 32 which provides a slanted drive mechanism engaging face 34 is mounted on the drive rail 20. This brake member 32 is adapted to engage the drive wheel 24 which is located on the same side of the drive rail 20 so as to gradually brake the gate as the slanted drive mechanism engaging face engages the drive wheel. The gradual braking occurs as the slanted face of the brake member gradually wedges between that drive wheel 24 and the drive rail 20 of the gate. The brake member 32 has a width which sufficiently spans the width of the drive rail 20 so as to ensure full contact with the drive wheel 24.

In the preferred embodiment, the slanted face 34 forms an angle 35 in the range of 30°–45° relative the base of the brake member and the planar surface of the rail 20. It has been found that an angle in this range is sufficient to effectively stop the movement of the gate while preventing a sudden cessation of gate movement.

Further in the preferred embodiment, the brake member is composed of a non-metallic substance, such as polyurethane or rubber, which has a high durometer hardness sufficient to resist substantial deformation on contact with the drive wheel 24 without posing the possibility of lacerating or otherwise adversely affecting the drive wheel 24. Aluminum or other metallic materials may be utilized, however, care would then have to be taken in eliminating burrs or other aberrations which could cut the elastomeric surface of the drive wheel 24.

An alignment wheel 48 is used to guide the drive rail 20 relative the drive wheels 24. The alignment wheel 48 engages a track 50 on the underside of the rail to position the drive wheels 24 on opposed flat surfaces of the rail 20. The alignment wheel further maintains the alignment of the components mounted on the drive rail 20 with corresponding components of the drive mechanism 14.

A pair of brake members 32 are disposed on opposite ends of the drive rail and each operating respectively to brake the gate as it is moved in opposite directions. A pair of limit switches 52 are disposed in association with the controls for the drive mechanism 14 which operate to deactivate the drive mechanism when tripped from either direction. Correspondingly, a pair of switch engaging members 54 are disposed on the drive rail to trip the limit switches 52 after the gate has moved a predefined distance. One switch engaging member 54 is disposed proximate opposite ends of the gate 10 for use as the gate moves in either direction. Thus, a single limit switch 52 and switch engaging member 54 are operative for movement of the gate in one direction and the others are operative for opposite movement of the gate.

The limit switches 52 are wired into the control panel 56 of the drive mechanism 14 in a manner which allows the control system to deactivate the drive wheels 24 and toggle the directional valve 28 to set the drive wheels 24 for rotation in the opposite direction when next activated. Thus, each time the drive mechanism is activated the wheels are rotated to rotate in the opposite direction of the most recent previous operation. Further, a bypass valve 58 may be included for manual operation of the gate so as to bypass this coordinated control system for system tests and the like.

In the most preferred embodiment, the brake members 32 are positioned on the gate beyond the point where the gate will stop coasting in the typical situation after being deactivated by the limit switch. Given an average coasting distance which depends on the size, weight, and type of gate structure utilized, one can establish a distance X between the positions of the brake member 32 and switch engaging member 54 on the drive rail 20 in view of the distance Y between a limit switch 52 and the drive wheels 24 such that the gate will generally stop prior to engaging the brake member 32. For example, if a specific gate typically coasts six inches, the brake member may be attached by suitable fasteners, such as bolt 51 and nut 53 so as to be eight inches away from the drive wheel upon deactivation. Thus, eight inches of coasting must occur before contact with the brake member is made.

In this manner, the brake member acts only in emergency situations where the gate travels more than a normal amount. By positioning the brake member beyond the point where the gate would stop normally the brake member only impacts the wheels in such emergency situations and accordingly minimizes any impact resultant from contact with the brake member. The relative positions of these components clearly depend on the distance Y between the switch 52 and drive wheels 24, as well as the size and weight of the gate. Such positions will vary considerably between various gate structures, but can be easily determined using this methodology.

The present invention thus encompasses a preferred method of controlling the movement of a gate member wherein a movable gate and associated drive mechanism is provided and a switching engaging member is provided on the gate which is adapted to deactivate the operation of the drive mechanism by tripping a limit switch thereon. Further, the method includes the step of positioning a brake member on the gate at a point beyond the point where the gate will stop after the switch engaging member deactivates the drive mechanism. This brake member includes a slanted drive mechanism engaging face such that in situations where the gate does not stop prior to the brake member, the brake member gradually brakes the gate.

From the foregoing description of the preferred embodiment it can be seen that various alternative embodiments of the invention can be anticipated without departure from the scope of the invention as defined in the following claims.

I now claim:

1. In a slide gate mechanism, wherein a gate is controllably moved transversely across a pathway by a drive mechanism comprising at least one drive wheel adapted to frictionally engage a portion of said gate to systematically block or unblock the pathway, the improvement comprising at least one brake member disposed on said portion of said gate which said drive mechanism is adapted to engage, said at least one brake member including a slanted drive mechanism engaging face adapted to engage said at least one drive wheel of said drive mechanism so as to gradually brake said gate.

2. The apparatus of claim 1, wherein said portion of said gate comprises a drive rail secured along said gate.

3. The apparatus of claim 2, wherein said at least one drive wheel is spring-biased toward said drive rail to ensure adequate frictional engagement with said drive rail.

4. The apparatus of claim 1, wherein a pair of brake members are disposed on opposite ends of said portion of said gate, each brake member being respectively operative to brake said gate as it is moved in opposed directions.

5. The apparatus of claim 1, wherein:

at least one limit switch is disposed on said drive mechanism which is operative to deactivate said drive mechanism;

at least one switch-engaging member is disposed on said gate to trip said at least one limit switch; and said at least one brake member is further positioned on said portion of said gate beyond the point where said gate will stop after said switch-engaging member deactivates said drive mechanism.

6. The apparatus of claim 5, wherein said at least one switch-engaging member is disposed on said portion of said gate.

7. The apparatus of claim 1, wherein said slanted drive mechanism engaging face forms an angle relative to the base of the brake member in the range of 30°–45°.

8. A slide gate mechanism comprising:

a gate adapted to be moved across a pathway and including a drive rail secured therealong;

a drive mechanism including a pair of opposed drive wheels adapted to frictionally engage said drive rail and controllably move said gate across said pathway, said pair of opposed drive wheels being spring-biased toward said drive rail so as to ensure adequate frictional engagement with said rail;

a first limit switch positioned on said drive mechanism which is adapted to deactivate operation of said drive mechanism in a first direction;

a second limit switch positioned on said drive mechanism which is adapted to deactivate operation of said drive mechanism in an opposed second direction;

a pair of switch-engaging members secured proximate opposite ends of said gate and each being operative to engage a respective one of said first and second limit switches; and a pair of brake members secured proximate opposite ends of said drive rail of said gate at a position beyond the point where said gate will stop after said switch-engaging member on the respective end deactivates said drive mechanism, each said brake member having a slanted drive mechanism engaging face such that in situations where movement of said gate does not stop prior to said corresponding brake member, said brake member operates to gradually brake said gate as at least one of said drive wheels engages said slanted drive mechanism engaging face.

9. The apparatus of claim 8, wherein the slanted drive mechanism engaging face on each brake member forms an angle relative to the base of the brake member in the range of 30°–45°.

10. A method of controlling the movement of a gate member, comprising the steps of:

providing a movable gate;

providing a drive mechanism for laterally translating said gate across a location to be blocked;

providing a switch engaging member on said gate adapted to deactivate the operation of said drive mechanism by tripping a limit switch on said drive mechanism; and positioning a brake member on said gate at a position beyond the point where said gate will stop after said switch engaging member deactivates said drive mechanism, said brake member having a slanted drive mechanism engaging face such that in situations where said gate does not stop prior to said brake member, said brake member gradually brakes said gate.

* * * * *